United States Patent [19]

Ivy et al.

[11] 4,324,757

[45] Apr. 13, 1982

[54] HALOGENATED HYDROCARBONS INHIBITED AGAINST DENICKELIFICATION WITH LOWER ALKYLCYANIDE COMPOUNDS

[75] Inventors: John B. Ivy; Ted S. Boozalis, both of Lake Jackson, Tex.

[73] Assignee: The Dow Chemical Company, Midland, Mich.

[21] Appl. No.: 53,671

[22] Filed: Jul. 2, 1979

[51] Int. Cl.[3] ..... F28F 19/00; C23F 11/14

[52] U.S. Cl. ..... 422/7; 165/134 R; 106/14.15; 106/14.42; 252/170; 252/171; 252/390; 252/68; 570/110

[58] Field of Search ..... 252/390, 170, 171, 172, 252/68; 260/652.5 R; 106/14.15, 14.42; 422/7; 570/110

[56] References Cited

U.S. PATENT DOCUMENTS

| | | | |
|---|---|---|---|
| 2,043,260 | 6/1936 | Missbach | 252/392 |
| 3,113,156 | 12/1963 | Sims | 252/405 |
| 3,277,193 | 10/1966 | Fullhant | 260/652.5 R |
| 3,445,532 | 5/1969 | Richtzenhain et al. | 260/652.5 R |
| 3,549,715 | 12/1970 | Cormany et al. | 260/652.5 R |
| 3,564,061 | 2/1971 | Correia et al. | 260/652.5 R |
| 3,723,331 | 3/1973 | Correia | 260/652.5 R |

OTHER PUBLICATIONS

Heidersbach, Corrosion, (Feb.1968) pp. 38–44.
Henthorne, Chemical Eng., (May 1971) pp. 127–132.

*Primary Examiner*—Benjamin R. Padgett
*Assistant Examiner*—Irwin Gluck
*Attorney, Agent, or Firm*—Douglas N. Deline

[57] ABSTRACT

Metal alloys containing nickel are protected from denickelification upon exposure to halogenated hydrocarbons at elevated temperatures by the addition of a lower alkylcyanide in minor proportions to the halogenated hydrocarbon.

11 Claims, No Drawings

HALOGENATED HYDROCARBONS INHIBITED AGAINST DENICKELIFICATION WITH LOWER ALKYLCYANIDE COMPOUNDS

BACKGROUND OF THE INVENTION

The halogenated hydrocarbons have been widely used as solvents and in other applications for many years. There have been developed numerous inhibitor systems to retard decomposition of certain of these halogenated hydrocarbons. In particular it has been found that such inhibitors are necessary to prevent decomposition and even detonation of certain halogenated derivatives of lower aliphatic hydrocarbons especially when these compounds are in contact with certain metals such as aluminum and iron. Without such an inhibitor a halogenated hydrocarbon can in a short time period decompose into a thick gummy carbonaceous mass quite unsuitable for most uses.

It has likewise been found that the halogenated hydrocarbon solvents should contain an additive to inhibit corrosion of metal objects brought into contact with such solvents. For example, U.S. Pat. No. 1,097,145 discloses the use of an unsaturated hydrocarbon additive to absorb chlorine radicals produced by decomposition of a chlorinated hydrocarbon by ultraviolet light, oxygen or other means thus preventing the chlorine radicals from attacking the metal.

A particular form of corrosion occurring in the storage and use of halogenated hydrocarbon solvents is crevice corrosion wherein small crevices of a metal in contact with the solvent become particularly susceptible to corrosion attack. The process is discussed in more detail in M. Henthorne, Fundamentals of Corrosion, Chem. Eng., 78(11), 127–132 (1971) wherein the following reasons for crevice corrosion occurring were formulated: (a) changes in acidity in the crevice, (b) lack of oxygen in the crevice, (c) buildup of detrimental ion species in the crevice, and (d) depletion of inhibitor in the crevice.

Particular compounds disclosed in the prior art as suitable inhibitors for use with halogenated hydrocarbon solvents to inhibit the decomposition of the solvent and to prevent crevice corrosion of metals include dioxane, nitromethane, cyclohexane, lower aliphatic alcohols and propylene oxide.

Dealloying, a particularly deleterious corrosion process, is the selective removal of one component of a metal alloy by a chemical medium. The process generally occurs over a relatively long time period and may often be unobservable since the physical dimensions and other qualities of the affected material may be unaltered, but the structure is changed and therefore the strength of the metal alloy is often severely decreased.

The dealloying or more specifically, denickelification of nickel-containing alloys exposed to aqueous systems has been previously reported, but to our knowledge this process has not been known to occur in an organic, non-polar, non-aqueous medium. It has now been found that when halogenated hydrocarbons are exposed to nickel alloys and especially alloys of copper and nickel, particularly at elevated temperatures and pressures over long time periods, a dangerous and heretofore unobserved condition may result from the denickelification of such alloys under the action of the halogenated hydrocarbon. That this newly discovered condition is not the result of known corrosion processes involving halogenated hydrocarbons is demonstrated by the fact that the previously mentioned known corrosion and decomposition inhibitors useful in halogenated hydrocarbon solvent systems are ineffective in protecting against this denickelification process.

Particular operating conditions wherein the above-described denickelification process may occur are in for example, heat recovery and transfer systems employing the aforementioned halogenated hydrocarbons in contact with nickel alloys at elevated temperatures and pressures. Included are such systems employing halogenated hydrocarbons as the working fluid whether cooling is occasioned through using the specific heat of the fluid to transport heat to a recovery or exchanger means or through using the latent heat of vaporization of the fluid, such as in systems where the vapor is condensed in a cooler or exchanger and the liquid recirculated to be revaporized.

It would therefore be desirable to provide an inhibitor for use with halogenated hydrocarbons, particularly halogenated hydrocarbons used in a heat recovery and transport system, that effectively prevents denickelification of nickel alloys when in contact with such halogenated hydrocarbons.

SUMMARY OF THE INVENTION

The instant invention is a novel inhibitor in combination with a halogenated hydrocarbon or mixtures of such halogenated hydrocarbons for use under circumstances giving rise to the denickelification processes in the absence of said inhibitor. More particularly the invention comprises the use of a lower alkylcyanide for the inhibition of denickelification by halogenated hydrocarbons.

DETAILED DESCRIPTION OF THE INVENTION

The halogenated hydrocarbons for use in this invention are the halogenated aliphatic hydrocarbons having from 1 to 10 carbon atoms and substituted with from 1 to 10 halogen atoms. Also included are those compounds substituted with a mixture of halogen atoms and mixtures of such halogenated aliphatic hydrocarbons.

By "aliphatic" is also meant "cycloaliphatic". Examples include alkanes, alkenes, alkadienes, cyclic alkanes, cyclic alkenes, and cyclic alkadienes.

By halogen or halogenated, reference is made to fluorine, chlorine, bromine and iodine.

Preferred halogenated hydrocarbons according to this invention are halogenated aliphatic compounds having from 1 to 6 carbon atoms and from 1 to 6 fluorine, chlorine or mixtures of fluorine and chlorine atoms, or mixtures thereof.

The most preferred halogenated hydrocarbon is methylene chloride.

The inhibitors we have found that effectively prevent the denickelification of nickel alloys when exposed to the above-described halogenated hydrocarbons under the conditions hereinafter described are lower alkylcyanide compounds containing from 1 to 6 carbon atoms in the alkyl group or mixtures thereof. A preferred inhibitor is methylcyanide. The amount of inhibitor required to effectively prevent the denickelification process may vary depending on the particular nickel alloy, the halogenated hydrocarbon, and temperature employed. Generally, amounts expressed in weight percent from 0.01 to 10 percent may be employed, preferably from 0.5 to 5 percent.

While the denickelification of nickel-containing alloys in contact with halogenated hydrocarbons occurs in some degree at nearly all temperatures, its effect is most pronounced and deleterious at elevated temperatures, particularly under correspondingly elevated pressures such as would be encountered under autogenous conditions at temperatures above the normal boiling point of the halogenated hydrocarbon.

Preferred temperatures at which the inhibitors of this invention are effective are from about 40° C. to about 200° C. Most preferred temperatures are from about 80° C. to about 140° C.

The denickelification inhibitor of this invention also may be effectively used in combination with known decomposition inhibitors of the prior art such as dioxane, nitromethane, cyclohexane, the lower aliphatic alcohols having 1-10 carbons and propylene oxide. It has been found that lower alkylcyanide derivatives do not effectively prevent the crevice corrosion of some metals and alloys in contact with halogenated hydrocarbons, whereas nitromethane does prevent such corrosion. If inhibition of crevice corrosion in addition to denickelification is desired, an effective amount of a known corrosion inhibitor such as nitromethane may advantageously be used in combination with the denickelification inhibitor of this invention. Effective amounts of nitromethane range from about 0.01 to about 10 percent by weight.

SPECIFIC EMBODIMENTS

The following examples serve to illustrate the invention and are not to be construed as limiting.

Example 1

The behavior of halogenated hydrocarbons exposed to metal alloys at elevated temperatures was investigated under the following conditions. Test coupons of mild steel, 70:30 copper/nickel and 90:10 copper/nickel were installed in a pilot plant scale reflux unit containing dry, uninhibited methylene chloride and in sealed metal bombs filled with dry, uninhibited methylene chloride maintained at 140° C. in constant temperature ovens. Methylene chloride samples were collected periodically and analyzed for evidence of decomposition. After approximately one year the metal test coupons were removed and examined for corrosion.

Careful examination indicated the overall corrosion rates were quite low for all metals tested; generally less than 0.0004 cm/year. However, there was evidence of the occurrence of dealloying in the copper/nickel coupons. In particular the coupon of 90:10 copper/nickel suffered from general denickelification and the coupon of 70:30 copper/nickel evidenced localized or plug-type denickelification.

Example 2

A screening program was instituted to test various inhibitors for use in halogenated hydrocarbon systems. These experiments were carried out in sealed metal bombs containing coupons of mild steel, 70:30 copper/-nickel and 90:10 copper/nickel. The bombs were charged with dry methylene chloride containing about 1 percent by weight of an inhibitor, and mounted in constant temperature ovens maintained at about 140° C. The inhibitors tested included: nitromethane, cyclohexane, propylene oxide, dioxane, methyl butynol, 2,4-pentanedione, and methylcyanide.

Samples of methylene chloride solution were collected periodically and analyzed for decomposition. After about four months the metal coupons were removed and examined for crevice corrosion and denickelification. Of all the inhibitor compounds tested only the bombs containing methylene chloride inhibited with methylcyanide showed no evidence of denickelification.

The coupons exposed to methylene chloride, inhibited with methylcyanide showed evidence of crevice corrosion. Also, the rate of decomposition of methylene chloride inhibited by methylcyanide was significantly accelerated resulting in fouling of the test coupon by deposition of decomposition products.

Example 3

The reaction conditions of Example 2 were repeated using methylene chloride inhibited with approximately 1 percent by weight of a mixture of 50 percent methylcyanide and 50 percent nitromethane. Again after about four months exposure at 140° C. the coupons were removed for examination. The results showed no evidence of denickelification or of significant crevice corrosion. Decomposition of methylene chloride as determined by analysis of the methylene chloride solution for the presence of decomposition products was found to be extremely low.

What is claimed is:

1. A method of inhibiting the denickelification of a nickel alloy in contact with a halogenated aliphatic hydrocarbon having from 1 to 10 carbon atoms and from 1 to 10 halogen atoms capable of causing denickelification of the nickel alloy comprising maintaining a lower alkylcyanide compound having from 1 to 6 carbon atoms in the alkyl group capable of inhibiting denickelification of the nickel alloy dissolved in the halogenated aliphatic hydrocarbon in an amount sufficient to inhibit denickelification of the nickel alloy.

2. The method of claim 1 wherein the halogenated aliphatic hydrocarbon has from 1 to 6 carbon atoms and from 1 to 6 fluorine, chlorine or a mixture of fluorine and chlorine atoms.

3. The method of claim 1 wherein the halogenated aliphatic hydrocarbon is methylene chloride.

4. The method of claim 1 or 3 wherein the lower alkylcyanide compound is methylcyanide.

5. The method of claim 4 wherein the nickel alloy consists essentially of copper and nickel.

6. The method of claim 4 wherein the metal alloy is in contact with the halogenated aliphatic hydrocarbon under autogenous pressure at a temperature above its normal boiling point.

7. The method of claim 3 wherein the temperature is from about 80° C. to about 140° C.

8. The method of claim 7 wherein the lower alkylcyanide compound is methylcyanide.

9. The method of claim 4 wherein the methylcyanide is dissolved in a minor proportion between about 0.01 and about 10 percent by weight.

10. The improvement of claim 8 wherein the methylcyanide is maintained in a minor proportion between about 0.01 to about 10 percent by weight.

11. In a heat recovery and transfer system employing a halogenated aliphatic hydrocarbon having from 1 to 10 carbon atoms and from 1 to 10 halogen atoms or a mixture of such halogenated aliphatic hydrocarbons in contact with a nickel alloy under conditions capable of causing denickelification of the nickel alloy, the improvement comprising maintaining methylcyanide dissolved in the halogenated aliphatic hydrocarbon in an amount sufficient to inhibit denickelification of the nickel alloy.

* * * * *